US009307332B2

(12) United States Patent
Rasmussen et al.

(10) Patent No.: US 9,307,332 B2
(45) Date of Patent: Apr. 5, 2016

(54) METHOD FOR DYNAMIC SUPPRESSION OF SURROUNDING ACOUSTIC NOISE WHEN LISTENING TO ELECTRICAL INPUTS

(75) Inventors: Crilles Bak Rasmussen, Smørum (DK); Anders Højsgaard Thomsen, Smørum (DK)

(73) Assignee: OTICON A/S, Smorum (DK)

( * ) Notice: Subject to any disclaimer, the term of this patent is extended or adjusted under 35 U.S.C. 154(b) by 607 days.

(21) Appl. No.: 12/958,896

(22) Filed: Dec. 2, 2010

(65) Prior Publication Data

US 2011/0137649 A1 Jun. 9, 2011

Related U.S. Application Data

(60) Provisional application No. 61/266,179, filed on Dec. 3, 2009.

(30) Foreign Application Priority Data

Dec. 3, 2009 (EP) ..... 09177859

(51) Int. Cl.
*G10L 19/14* (2006.01)
*H04R 25/00* (2006.01)

(52) U.S. Cl.
CPC ..... *H04R 25/43* (2013.01); *H04R 25/356* (2013.01); *H04R 25/554* (2013.01); *H04R 2225/41* (2013.01); *H04R 2225/43* (2013.01); *H04R 2460/01* (2013.01)

(58) Field of Classification Search
CPC ..... H04R 2225/021; H04R 2225/051; H04R 2225/41; H04R 25/00; H04R 25/02; G10L 2021/065
USPC ..... 704/225, 226, 233
See application file for complete search history.

(56) References Cited

U.S. PATENT DOCUMENTS

| | | | | |
|---|---|---|---|---|
| 5,144,675 | A | 9/1992 | Killion et al. | |
| 5,457,769 | A | 10/1995 | Valley | |
| 5,473,701 | A | 12/1995 | Cezanne et al. | |
| 5,710,820 | A | 1/1998 | Martin et al. | |
| 6,061,431 | A * | 5/2000 | Knappe et al. | 379/52 |

(Continued)

FOREIGN PATENT DOCUMENTS

| | | | |
|---|---|---|---|
| EP | 1 460 769 | A1 | 9/2004 |
| EP | 1 691 573 | A2 | 8/2006 |

(Continued)

*Primary Examiner* — Jakieda Jackson
(74) *Attorney, Agent, or Firm* — Birch, Stewart, Kolasch & Birch, LLP

(57) ABSTRACT

A listening instrument includes a) a microphone unit for picking up an input sound from the current acoustic environment of the user and converting it to an electric microphone signal; b) a microphone gain unit for applying a specific microphone gain to the microphone signal and providing a modified microphone signal; c) a direct electric input signal representing an audio signal; d) a direct gain unit for applying a specific direct gain to the direct electric input signal and providing a modified direct electric input signal; e) a detector unit for classifying the current acoustic environment and providing one or more classification parameters; f) a control unit for controlling the specific microphone gain applied to the electric microphone signal and/or the specific direct gain applied to the direct electric input signal based on the one or more classification parameters.

24 Claims, 5 Drawing Sheets

(56) References Cited

U.S. PATENT DOCUMENTS

| | | | | |
|---|---|---|---|---|
| 6,438,071 | B1 * | 8/2002 | Hansen et al. | 367/88 |
| 7,522,730 | B2 * | 4/2009 | Vaughan et al. | 380/275 |
| 8,391,523 | B2 * | 3/2013 | Biundo Lotito et al. | 381/312 |
| 8,462,956 | B2 * | 6/2013 | Goldstein et al. | 381/56 |
| 8,540,650 | B2 * | 9/2013 | Salmi et al. | 600/595 |
| 2002/0105598 | A1 * | 8/2002 | Tai et al. | 348/705 |
| 2002/0147580 | A1 | 10/2002 | Mekuria et al. | |
| 2003/0112987 | A1 * | 6/2003 | Nordqvist et al. | 381/312 |
| 2005/0070337 | A1 * | 3/2005 | Byford et al. | 455/569.1 |
| 2006/0222194 | A1 * | 10/2006 | Bramslow et al. | 381/314 |
| 2006/0262944 | A1 * | 11/2006 | Rasmussen et al. | 381/110 |
| 2007/0009122 | A1 * | 1/2007 | Hamacher | 381/312 |
| 2007/0055508 | A1 * | 3/2007 | Zhao et al. | 704/226 |
| 2007/0189544 | A1 * | 8/2007 | Rosenberg | 381/57 |
| 2008/0189107 | A1 * | 8/2008 | Laugesen | 704/233 |
| 2009/0187065 | A1 * | 7/2009 | Basinger | 600/25 |
| 2009/0208043 | A1 * | 8/2009 | Woods et al. | 381/315 |
| 2009/0220096 | A1 * | 9/2009 | Usher et al. | 381/57 |
| 2009/0238385 | A1 * | 9/2009 | Fischer | 381/312 |
| 2010/0135511 | A1 * | 6/2010 | Pontoppidan | 381/313 |
| 2011/0261983 | A1 * | 10/2011 | Claussen et al. | 381/317 |
| 2012/0221328 | A1 * | 8/2012 | Muesch | 704/225 |
| 2013/0329051 | A1 * | 12/2013 | Boesen | 348/159 |

FOREIGN PATENT DOCUMENTS

| | | | |
|---|---|---|---|
| EP | 1 691 574 | A2 | 8/2006 |
| EP | 1 956 589 | A1 | 8/2008 |
| EP | 1 981 253 | A1 | 10/2008 |
| EP | 2 088 802 | A1 | 8/2009 |
| WO | WO 99/09786 | A1 | 2/1999 |
| WO | WO 03/032681 | A1 | 4/2003 |
| WO | WO 03/081947 | A1 | 10/2003 |
| WO | WO 2004/077090 | A1 | 9/2004 |
| WO | WO 2008/071230 | A1 | 6/2008 |
| WO | WO 2008/137870 | A1 | 11/2008 |
| WO | WO 2009/049645 | A1 | 4/2009 |

* cited by examiner

| Classification parameters | | Acoustic environment | $G_A$ | $G_W$ |
|---|---|---|---|---|
| LD | VD | | | |
| LOW LEVEL | VOICE | Background voice/NOISE | IM | H/IM |
| HIGH LEVEL | NO VOICE | Loud noise | L | H |
| LOW LEVEL | NO VOICE | Low noise | IM/L | H/IM |
| HIGH LEVEL | VOICE | Background voice/INFO | IM/L | H |

| LD | VD | $G_A$ | $G_W$ |
|---|---|---|---|
| LOW | VOICE | HIGH | LOW |
| HIGH | NOISE | LOW | HIGH |
| LOW | NOISE | LOW | LOW |
| HIGH | VOICE | LOW | HIGH |

| | T1 | T2 | T3 | T4 |
|---|---|---|---|---|
| OWN-VOICE | NOT OWN VOICE | OWN VOICE | NOT OWN VOICE | NOT OWN VOICE |
| LEVEL | LOW | HIGH | IM | HIGH |
| VOICE | NO VOICE | VOICE | VOICE | NO VOICE |
| AC. ENV. | LOW-NOISE | OWN VOICE | VOICE | HIGH-NOISE |
| $G_A$ | IM | --- | IM | LOW |
| $G_W$ | IM | --- | HIGH | HIGH |

METHOD FOR DYNAMIC SUPPRESSION OF SURROUNDING ACOUSTIC NOISE WHEN LISTENING TO ELECTRICAL INPUTS

CROSS REFERENCE TO RELATED APPLICATIONS

This application claims priority under 35 U.S.C. 119(e) to U.S. Provisional Application No. 61/266,179 filed on Dec. 3, 2009 and under 35 U.S.C. 119(a) to Patent Application No. 09177859.7 filed in Europe on Dec. 3, 2009. The entire contents of the above applications are hereby expressly incorporated by reference into the present application.

TECHNICAL FIELD

The present application relates to improving a signal to noise ratio in listening devices. The application relates specifically to a listening instrument adapted for being worn by a user and for receiving an acoustic input as well as an electric input representing an audio signal.

The application furthermore relates to the use of a listening instrument and to a method of operating a listening instrument. The application further relates to a data processing system comprising a processor and program code means for causing the processor to perform at least some of the steps of the method and to a computer readable medium storing the program code means.

The disclosure may e.g. be useful in applications such as hearing aids, headsets, active ear protection devices, head phones, etc.

BACKGROUND ART

The following account of the prior art relates to one of the areas of application of the present application, hearing aids.

Originally, wireless or wired electrical inputs to hearing aids were typically used to provide an amplified version of a surrounding acoustic signal. Examples of such systems providing an electric input could be telecoil systems used in churches or FM system used in schools to transmit a teacher's voice to hearing aid(s) of one or more hearing impaired persons.

In recent years, mobile communications has created a new situation where the electrical input signals can be totally unrelated to the surrounding audio environment. This allows for example a wearer of a hearing instrument to listen to music or talk on the phone, e.g. using telecoil or digital near field or far field radio systems.

In the latter situation the surrounding audio environment can interfere with the perceived audio quality and speech interpretation, if e.g. the listener is in a noisy environment.

This problem has historically been addressed in hearing aids by having two programs available for each type of electrical input, one for use in a noisy environment with only the electrical input (microphone off), and one for other use with both the electrical input and the hearing aid microphone(s) on.

Such solution solves the general problem. However, the user still has problems, if he/she is in a noisy environment and needs to address persons in their proximity, while receiving a direct electric input. If a wearer leaves the microphone(s) off, he/she will not be able to communicate with persons in the near proximity, and if he/she leaves the microphone(s) on, the signal to noise ratio (S/N) of the combined signal may be too low to allow him/her to understand the electrical input signal.

EP 1 691 574 A2 and EP 1 691 573 A2 describe a method for providing hearing assistance to a user of a hearing instrument comprising receiving first audio signals via a wireless audio link and capturing second audio signals via a microphone, analyzing at least one of the first and second audio signals by a classification unit in order to determine a present auditory scene category from a plurality of auditory scene categories, setting the ratio of the gain applied to the first audio signals and the gain applied to the second audio signals according to the present determined auditory scene category and mixing the first and second audio signals according to the set gain ratio in the hearing instrument.

DISCLOSURE OF INVENTION

The general idea of the present disclosure is to increase the signal to noise ratio of the combined acoustic and electric input signal of a listening instrument without necessarily turning the microphone(s) of the listening instrument off, based on varying the volume of either the microphone signal, or the electrical input, or both, according to a predefined scheme (such scheme being e.g. determined or influenced by the current acoustic environment).

The scheme may be implemented in signal processing blocks of the listening instrument and may additionally comprise a continuous monitoring of the surrounding acoustic signal and analysis of the incoming audio signal. The microphone gain and/or the gain applied to an electrical input signal can e.g. be varied depending on the surrounding acoustic signal (e.g. noise or speech).

An object of the present application is improve a signal to noise ratio in a listening instrument.

Objects of the application are achieved by the invention described in the accompanying claims and as described in the following.

An object of the application is achieved by a listening instrument adapted for being worn by a user and comprising a) a microphone unit for picking up an input sound from the current acoustic environment of the user and converting it to an electric microphone signal;
b) a microphone gain unit for applying a specific microphone gain to the electric microphone signal and providing a modified microphone signal;
c) a direct electric input signal representing an audio signal;
d) a direct gain unit for applying a specific direct gain to the direct electric input signal and providing a modified direct electric input signal;
e) a detector unit for classifying the current acoustic environment of the user and providing one or more classification parameters;
f) a control unit for controlling the specific microphone gain applied to the electric microphone signal and/or the specific direct gain applied to the direct electric input signal based on the one or more classification parameters;

wherein the detector unit comprises an own-voice detector (OVD) for determining whether or not the user is speaking at a given point in time.

An advantage of the invention is that it provides improved listening comfort to a user in different acoustic environments.

The classification of the current acoustic environment comprises advantageously inputs from one or more detectors or sensors of the detector unit located in the listening instrument, which during operation is worn by a user, typically located at or in an ear of a user. This has the advantage that the one or more detectors follow the user and thus is/are ideally positioned to monitor the current acoustic environment of the user. Further, such detectors may precisely monitor the own voice of the user (e.g. via an ear canal microphone or via processing of the signal picked up by the microphone for picking up an input sound from the current acoustic environment of the user). This has the advantage that the classification itself and the use of such classification can be performed in the same physical device, and thus do not suffer from time delays and/or incorrectness due to location differences of the detectors and/or the classification unit relative to the user.

The acoustic environment of the user may comprise any kind of sound, e.g. voices from people, noise from artificial (e.g. from machines or traffic) or natural (e.g. from wind or animals) sources. The voices (e.g. comprising human speech or other utterances) may originate from the user him- or herself or from other persons in the local environment of the user. The voices or other sounds in the environment of the user being picked up by a microphone system of the listening instrument may in an embodiment be considered as NOISE that is preferably NOT perceived by the user or in another embodiment as INFORMATION that (at least to a certain extent) is valuable for the user to perceive (e.g. some traffic sounds or speech messages from nearby persons). The 'local environment' of a user is in the present context taken to mean an area around the user from which sound sources may be perceived by a normally hearing user. In an embodiment, such area is adapted to a possible hearing impairment of the user. In an embodiment, 'local environment' is taken to mean an area around a user defined by a circle or radius less than 100 m, such as less than 20 m, such as less than 5 m, such as less than 2 m.

In general, the classification parameter or parameters provided by the detector unit may have values in a continuous range or be limited to a number of discrete values, e.g. two or more, e.g. three or more.

In an embodiment, the electric microphone signal is connected to the own-voice detector. In an embodiment, the own-voice detector is adapted to provide a control signal indicating whether or not the voice of a user is present in the microphone signal at a given time.

In an embodiment, the detector unit is adapted to classify the microphone signal as an OWN-VOICE or NOT OWN-VOICE signal. This has the advantage that time segments of the electric microphone signal comprising the user's own voice can be separated from time segments only comprising other voices and other sound sources in the user's environment.

In an embodiment, the listening instrument is adapted to provide a frequency dependent gain to compensate for a hearing loss of a user.

In an embodiment, the listening instrument comprises a directional microphone system adapted to separate two or more acoustic sources in the local environment of the user wearing the listening instrument. In an embodiment, the directional system is adapted to detect (such as adaptively detect) from which direction a particular part of the microphone signal originates. This can be achieved in various different ways as e.g. described in U.S. Pat. No. 5,473,701 or in WO 99/09786 A1 or in EP 2 088 802 A1.

In an embodiment, the listening instrument comprises a mixing unit for allowing a simultaneous presentation of the modified microphone signal and the modified direct electric input signal. By properly adapting the relative gain of the microphone and direct electric signals (as e.g. determined or influenced by a detector unit of the listening instrument), a simultaneous perception by the user of the acoustic input and the direct electric input is facilitated. In an embodiment, the mixing unit provides as an output a sum of the input signals. In an embodiment, the mixing unit provides as an output a weighted sum of the input signals. In an embodiment, the weights are used as an alternative to the gains applied to the microphone and direct electric signals, so that the mixing unit is an alternative to separate gain units for each of the microphone and direct electric signals.

In an embodiment, the detector unit comprises a level detector (LD) for determining the input level of the electric microphone signal and provide a LEVEL parameter. The input level of the electric microphone signal picked up from the user's acoustic environment is a classifier of the environment. In an embodiment, the detector unit is adapted to classify a current acoustic environment of the user as a HIGH-LEVEL or LOW-LEVEL environment. Level detection in hearing aids is e.g. described in WO 03/081947 A1 or U.S. Pat. No. 5,144,675.

In a particular embodiment, the detector unit comprises a voice detector (VD) (also termed a voice activity detector (VAD)) for determining whether or not the electric microphone signal comprises a voice signal (at a given point in time). A voice signal is in the present context taken to include a speech signal from a human being. It may also include other forms of utterances generated by the human speech system (e.g. singing). In an embodiment, the detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the detector unit is adapted to classify the microphone signal as HIGH-NOISE or LOW-NOISE signal. Such classification can e.g. be based on inputs from one or more of the own-voice detector, a level detector, and a voice detector. In an embodiment, an acoustic environment is classified as a HIGH-NOISE environment, if at a given time instant, the input LEVEL of the electric microphone signal is relatively HIGH (e.g. as defined by a binary LEVEL parameter or by a continuous LEVEL value and a predefined LEVEL threshold), and the voice detector has detected NO-VOICE (and optionally if the own-voice detector has detected NO-OWN-VOICE). Correspondingly a LOW-NOISE environment may be identified, if at a given time instant, the input LEVEL of the electric microphone signal is relatively LOW and at the same time NO-VOICE, and optionally NO-OWN-VOICE, are detected.

In a particular embodiment, the listening instrument is adapted to estimate a NOISE input LEVEL during periods, where the user's own voice is NOT detected by the own-voice detector (i.e. the microphone signal is classified as a NOT OWN-VOICE signal). This has the advantage that the noise estimate is based on sounds NOT originating from the user's own voice. In a particular embodiment, the listening instrument is adapted to estimate a NOISE input LEVEL during periods where a voice is NOT detected by the voice detector (i.e. the environment is classified as a NO-VOICE environment). This has the advantage that the noise estimate is based on sounds NOT originating from human voices in the user's local environment. In an embodiment, a control signal from the own-voice detector and/or from a voice detector is/are fed to the level detector and used to control the estimate of a current noise level, including the timing of the measurement of the NOISE input LEVEL.

In an embodiment, the listening instrument is adapted to use the NOISE input level to adjust the gain of the microphone and/or the electric input signal to maintain a constant signal to noise ratio. If the ambient noise level e.g. increases, this can e.g. be accomplished by increasing the gain ($G_W$) of the direct electric input and/or to decrease the gain ($G_A$) of the microphone input.

In an embodiment, the listening instrument is adapted to use the NOISE level to adjust the gain of the microphone and/or the electric input signal in connection with a telephone conversation, when the direct electric input represents a telephone input signal. This has the advantage that the incoming telephone signal and the signal picked up from the current acoustic environment can be mutually optimized. In an embodiment, the direct electric input represents a streaming (e.g. real-time) audio signal, e.g. from a TV or a PC.

In an embodiment, the control unit is adapted to apply a relatively low microphone gain ($G_A$) and/or a relatively high direct gain ($G_W$) in case a current acoustic environment of the user is classified as HIGH-LEVEL.

In an embodiment, the control unit is adapted to apply a relatively high direct gain ($G_W$) in case a current acoustic environment of the user is classified as LOUD NOISE (HIGH input LEVEL of NOISE).

In an embodiment, the control unit is adapted to apply a relatively high microphone gain ($G_A$) in case a current acoustic environment of the user is classified as QUIET NOISE (LOW input LEVEL of NOISE).

In an embodiment, the control unit is adapted to apply an intermediate microphone gain ($G_A$) in case a current acoustic environment of the user is classified as VOICE (preferably not originating from the user's own voice).

In an embodiment, the control unit is adapted to apply no gain regulation in case a current acoustic environment of the user is classified as an OWN-VOICE environment. In an embodiment, the gains $G_A$ and $G_W$ are maintained at their previous settings in an OWN-VOICE environment. In an embodiment, the gains $G_A$ and $G_W$ are set to default values appropriate for the own voice situation in an OWN-VOICE environment.

In an embodiment, the listening instrument comprises an antenna and transceiver circuitry for receiving a direct electric input signal. In an embodiment, the listening instrument comprises a (possibly standardized) electric interface (e.g. in the form of a connector) for receiving a wired direct electric input signal. In an embodiment, the listening instrument comprises demodulation circuitry for demodulating the received direct electric input to provide the direct electric input signal representing an audio signal.

In an embodiment, the listening instrument comprises a signal processing unit for enhancing the input signals and providing a processed output signal. In an embodiment, the listening instrument comprises an output transducer for converting an electric signal to a stimulus perceived by the user as an acoustic signal. In an embodiment, the output transducer comprises a number of electrodes of a cochlear implant or a vibrator of a bone conducting hearing device. In an embodiment, the output transducer comprises a receiver (speaker) for providing the stimulus as an acoustic signal to the user.

In an embodiment, the listening instrument further comprises other relevant functionality for the application in question, e.g. acoustic feedback suppression, etc.

In an embodiment, the listening instrument comprises a forward path between an input transducer (microphone system and/or direct electric input (e.g. a wireless receiver)) and an output transducer. In an embodiment, the signal processing unit (or at least a part for applying a frequency dependent gain to the signal) is located in the forward path. In an embodiment, the signal processing unit is adapted to provide a frequency dependent gain according to a user's particular needs. In an embodiment, the listening instrument comprises a receiver unit for receiving the direct electric input. The receiver unit may be a wireless receiver unit comprising antenna, receiver and demodulation circuitry. Alternatively, the receiver unit may be adapted to receive a wired direct electric input.

In an embodiment, the signal of the forward path is processed in the time domain. Alternatively, the signal of the forward path is processed individually in a number of frequency bands.

In an embodiment, the microphone unit and or the receiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain.

In an embodiment, the frequency range considered by the listening instrument from a minimum frequency $f_{min}$ to a maximum frequency $f_{max}$ comprises a part of the typical human audible frequency range from 20 Hz to 20 kHz, e.g. from 20 Hz to 12 kHz. In an embodiment, the frequency range $f_{min}$-$f_{max}$ considered by the listening instrument is split into a number P of frequency bands, where P is e.g. larger than 2, such as larger than 5, such as larger than 10, such as larger than 50, such as larger than 100, at least some of which are processed individually. In an embodiment, the detector unit and/or the control unit is/are adapted to process their input signals in a number of different frequency ranges or bands.

In an embodiment, the individual processing of frequency bands contributes to the classification of the acoustic environment. In an embodiment, the detector unit is adapted to process one or more (such as a majority or all) frequency bands individually. In an embodiment, the level detector is capable of determining the level of an input signal as a function of frequency. This can be helpful in identifying the kind or type of (microphone) input signal.

In an embodiment, the listening instrument comprises a hearing instrument, a head set, a head phone, an ear protection device, or a combination thereof.

An Audio Processing Device:

An audio processing device is furthermore provided by the present application. The audio processing device comprises a) an electric input for receiving an electric microphone signal representing an acoustic signal;
b) a microphone gain unit for applying a specific microphone gain to the microphone signal and providing a modified microphone signal;
c) a direct electric input signal representing an audio signal;
d) a direct gain unit for applying a specific direct gain to the direct electric input signal and providing a modified direct electric input signal;
e) a detector unit for classifying the current acoustic environment of the user and providing one or more classification parameters;
f) a control unit for controlling the specific microphone gain applied to the electric microphone signal and/or the specific direct gain applied to the direct electric input signal based on the one or more classification parameters;

wherein the detector unit comprises an own-voice detector (OVD) for determining whether or not the user is speaking at a given point in time.

It is intended that the structural features of the listening instrument described above, in the detailed description of 'mode(s) for carrying out the invention' and in the claims can be combined with the audio processing device, where appropriate. Embodiments of the method have the same advantages as the corresponding listening instrument.

In an embodiment, the audio processing device form part of an integrated circuit. In an embodiment, the audio processing device form part a processing unit of a listening device.

In an embodiment, the audio processing device form part of a hearing instrument, a headset, an active ear protection device, a headphone or combinations thereof is provided.

Use:

Use of a listening instrument as described above, in the detailed description of 'mode(s) for carrying out the invention', and in the claims is furthermore provided by the present application. In an embodiment, use in a hearing instrument, a headset, an active ear protection device, a headphone or combinations thereof is provided.

Use of an audio processing device as described above, in the detailed description of 'mode(s) for carrying out the invention', and in the claims is furthermore provided by the present application. In an embodiment, use in a hearing instrument, a headset, an active ear protection device, a headphone or combinations thereof is provided.

A Method:

A method of operating a listening instrument adapted for being worn by a user is moreover provided by the present application. The method comprises a) converting an input sound from the current acoustic environment of the user to an electric microphone signal;
b) applying a specific microphone gain to the electric microphone signal and providing a modified microphone signal;
c) providing a direct electric input signal representing an audio signal;
d) applying a specific direct gain to the direct electric input signal and providing a modified direct electric input signal;
e) classifying the current acoustic environment of the user, including determining whether or not the user is speaking at a given point in time, and providing one or more classification parameters;
f) controlling the specific microphone gain applied to the electric microphone signal and/or the specific direct gain applied to the direct electric input signal based on the one or more classification parameters;
g) determining whether or not the user is speaking at a given point in time.

It is intended that the structural features of the listening instrument described above, in the detailed description of 'mode(s) for carrying out the invention' and in the claims can be combined with the method, when appropriately substituted by a corresponding process. Embodiments of the method have the same advantages as the corresponding listening instrument.

A Computer Readable Medium:

A tangible computer-readable medium storing a computer program comprising program code means for causing a data processing system to perform at least some (such as a majority or all) of the steps of the method described above, in the detailed description of 'mode(s) for carrying out the invention' and in the claims, when said computer program is executed on the data processing system is furthermore provided by the present application. In addition to being stored on a tangible medium such as diskettes, CD-ROM-, DVD-, or hard disk media, or any other machine readable medium, the computer program can also be transmitted via a transmission medium such as a wired or wireless link or a network, e.g. the Internet, and loaded into a data processing system for being executed at a location different from that of the tangible medium. Preferably, at least steps b), d), e), f) and g) are included.

A Data Processing System:

A data processing system comprising a processor and program code means for causing the processor to perform at least some (such as a majority or all) of the steps of the method described above, in the detailed description of 'mode(s) for carrying out the invention' and in the claims is furthermore provided by the present application. Preferably, at least steps b), d), e), f) and g) are included.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the application, while other details are left out. Throughout, the same reference numerals or signs are used for identical or corresponding parts.

Further scope of applicability of the present application will become apparent from the detailed description given hereinafter. However, it should be understood that the detailed description and specific examples, while indicating preferred embodiments of the application, are given by way of illustration only, since various changes and modifications within the spirit and scope of the application will become apparent to those skilled in the art from this detailed description.

MODE(S) FOR CARRYING OUT THE INVENTION

Figure 1A:
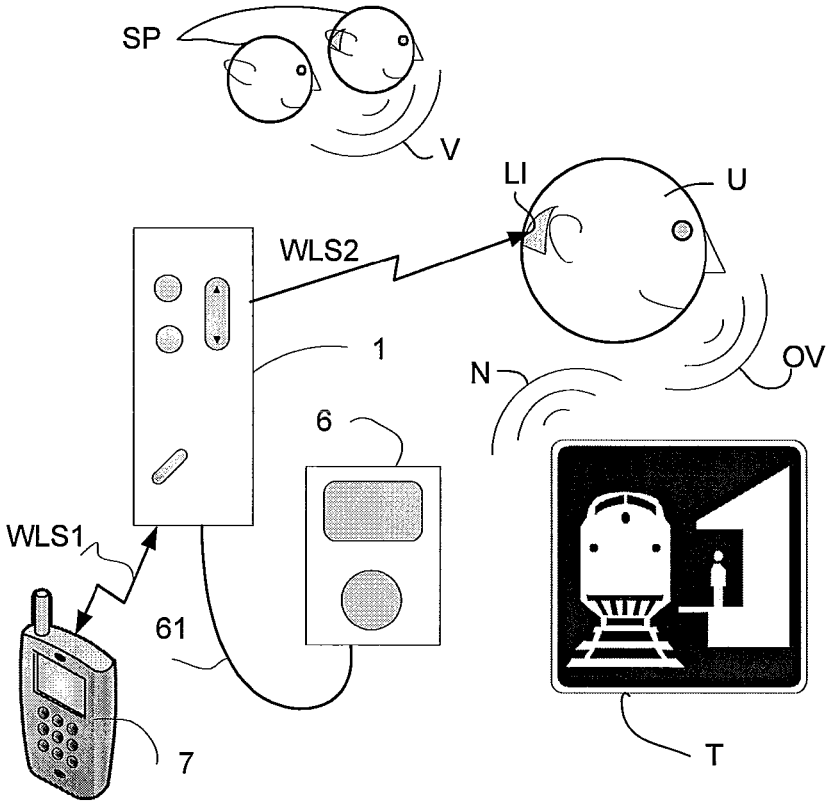
FIG. 1 shows a listening scenario comprising a specific acoustic environment for a user wearing a listening instrument in FIG. 1*a*, an embodiment of a listening instrument comprising a detector and control unit being shown in FIG. 1*b*, and an embodiment of a detector and control unit being shown in FIG. 1*c*.

FIG. 1*a* shows a listening scenario comprising a specific acoustic environment for a user wearing a listening instrument. FIG. 1*a* shows a user U wearing a listening instrument LI adapted for being worn by the user. A listening instrument is typically adapted to be worn at or in an ear of a user. In an embodiment, the listening instrument comprises a hearing instrument being adapted or fitted to a particular user (e.g. to compensate for a hearing impairment). The listening instrument LI is adapted to receive an audio signal from an audio gateway 1 as a direct electric input (WI in FIG. 1*b*), here a wireless input received via a wireless link WLS2. The audio gateway 1 is adapted for receiving a number of audio signals from a number of audio sources, here cellular phone 7 via wireless link WLS1, and audio entertainment device (e.g. music player) 6 via wired connection 61 and for transmitting a selected one of the audio signals to the listening instrument LI via wireless link WLS2. The listening instrument LI comprises—in addition to the direct electric input—an input transducer (e.g. a microphone system) for picking up sounds from the environment of the user and converting the input sound signal to an electric microphone signal (MI in FIG. 1*b*). The (time varying) local acoustic environment of the user U comprises voices V from speakers SP (which may or may not be of interest to the user), sounds N from a traffic scene T (which may or may not be of interest to the user, but is here anticipated to be noise) and the user's own voice OV.

Figure 1B:
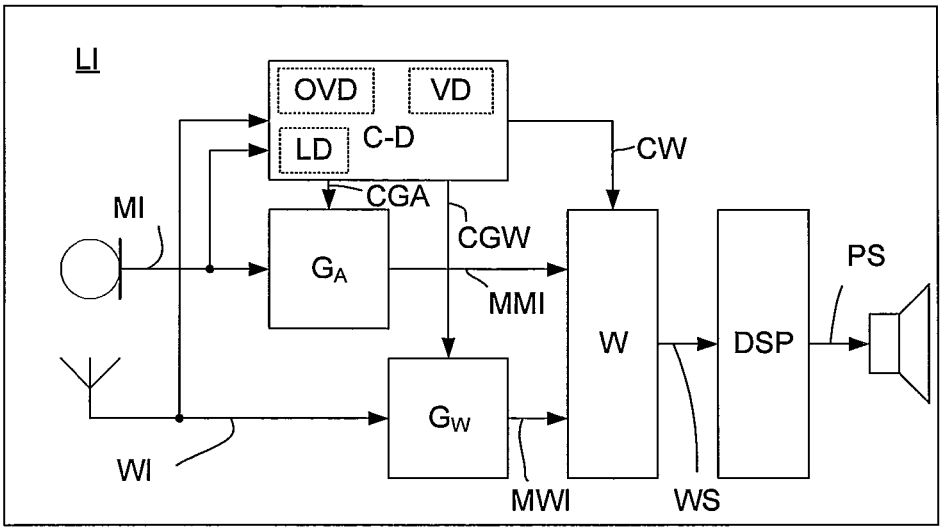

FIG. 1*b* shows an embodiment of a listening instrument LI of the scenario of FIG. 1*a*. The listening instrument LI comprises a microphone unit (cf. microphone symbol in FIG. 1*b*) for picking up an input sound from the current acoustic environment of the user (U in FIG. 1*a*) and converting it to an electric microphone signal MI. The listening instrument LI further comprises antenna and transceiver circuitry (cf. antenna symbol in FIG. 1*b*) for wirelessly receiving (and possibly demodulating) a direct electric input representing an audio signal WI. The listening instrument LI further comprises a microphone gain unit $G_A$ for applying a specific microphone gain to the microphone signal MI and providing a modified microphone signal MMI and a direct gain unit $G_W$ for applying a specific direct gain to the direct electric input signal WI and providing a modified direct electric input signal MWI. The listening instrument LI further comprises a control- and detector-unit (C-D) comprising a detector part for classifying the current acoustic environment of the user and providing one or more classification parameters and a control part for controlling the specific microphone gain $G_A$ applied to the electric microphone signal and/or the specific direct gain $G_W$ applied to the direct electric input signal based on the one or more classification parameters from the detector unit. In the embodiment shown, various detectors are indicated to form part of the control- and detector-unit (C-D): a) VD, (Voice Detector for determining whether or not a voice of a human is present at a given point in time), b) LD (Level Detector for determining the time varying level of the input signal(s)) and c) OVD (Own-Voice Detector for determining whether or not the user is speaking at a given point in time). The control- and detector-unit (C-D) is illustrated in more detail in FIG. 1*c*. The electric microphone signal MI and (optionally) the direct electric input signal WI are, in addition to the respective gain units $G_A$ and $G_W$, fed to the control- and detector-unit (C-D) for evaluation by the detectors. The embodiment of a listening instrument shown in FIG. 1*b* further comprises a mixing or weighting unit W for providing a (possibly weighted) sum WS of the input signals MMI and MWI, which are fed to the weighting unit W from the respective gain units $G_A$ and $G_W$. The output WS of the weighting unit W is fed to a signal processing unit DSP for processing the input signal WS and providing a processed output signal PS, which is fed to an output transducer (receiver symbol in FIG. 1*b*) for being presented to a user as a sound signal comprising a mixture of the microphone input and the direct electric audio input. The mixing or weighting unit W is controlled by input signal CW provided by the control- and detector-unit (C-D). In an embodiment, the mixing or weighting unit W is a simple SUM-unit providing as an output the sum of the input signals (in which case no control signal CW is needed). Alternatively, the weighting unit may control the relative gains of the two input signals (so that the gain units $G_A$, $G_W$ form part of the weighting unit W).

Figure 1C:
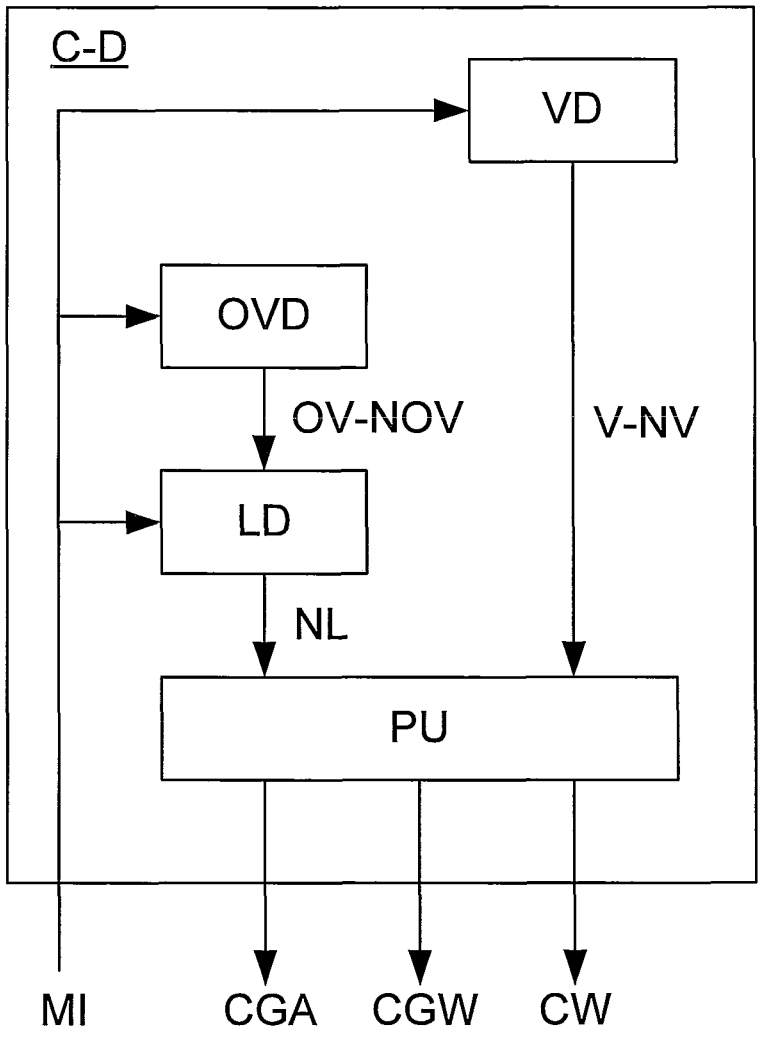

FIG. 1*c* shows an embodiment of a control- and detector-unit (C-D) forming part of the listening instrument LI of FIG. 1*b*.

The control- and detector-unit (C-D) comprises an own voice detector OVD for detecting and extracting a user's own voice (this can e.g. be implemented as described in WO 2004/077090 A1 or in EP 1 956 589 A1). The detection of a user's own voice can e.g. be used to decide when the signal picked up by the microphone system is 'noise' (e.g. not own-voice) and when it is 'signal'. In such case, an estimate of the noise can be made during periods, where the user's own voice is NOT detected. Preferably, the estimated noise level is a result of a time-average taken over a predefined time, e.g. more than 0.5 s, e.g. in the range from 0.5 s to 5 s. Preferably, the estimated noise level is based on an average over a single time segment comprising only noise. Alternatively, it may comprise a number of consecutive time segments comprising only noise (but separated by time segments comprising also voice). In an embodiment, the noise estimate is based on a running average that is currently updated so that the oldest contributions to the average are substituted by new. The improved noise estimate can be used to adjust the gain of the microphone and/or the electric input signal to maintain a constant signal to noise ratio. In an embodiment, the noise estimation based on the detection of own voice is used in connection with a telephone conversation (cf. e.g. scenario of FIG. 3*b*).

In an embodiment, the control- and detector-unit (C-D) comprises a level detector (LD) and the gain setting is simply controlled based on sound level picked up by the microphone unit. In an embodiment, a gain setting algorithm is implemented as described in the following. Level detectors are e.g. described in WO 03/081947 A1 or U.S. Pat. No. 5,144,675.

The microphone gain is reduced in noisy environments (compared to less noisy environments). The gain of the direct electrical input may simultaneously be increased (up to a level representing a maximum acceptable level for the user). This will improve the signal to noise ratio of the combined signal. In silent environments, the same signal to noise ratio can be achieved with lesser or no attenuation of the microphone signal, and lesser or no additional gain on the direct electrical input.

Figures 2A, 2B, 2C:
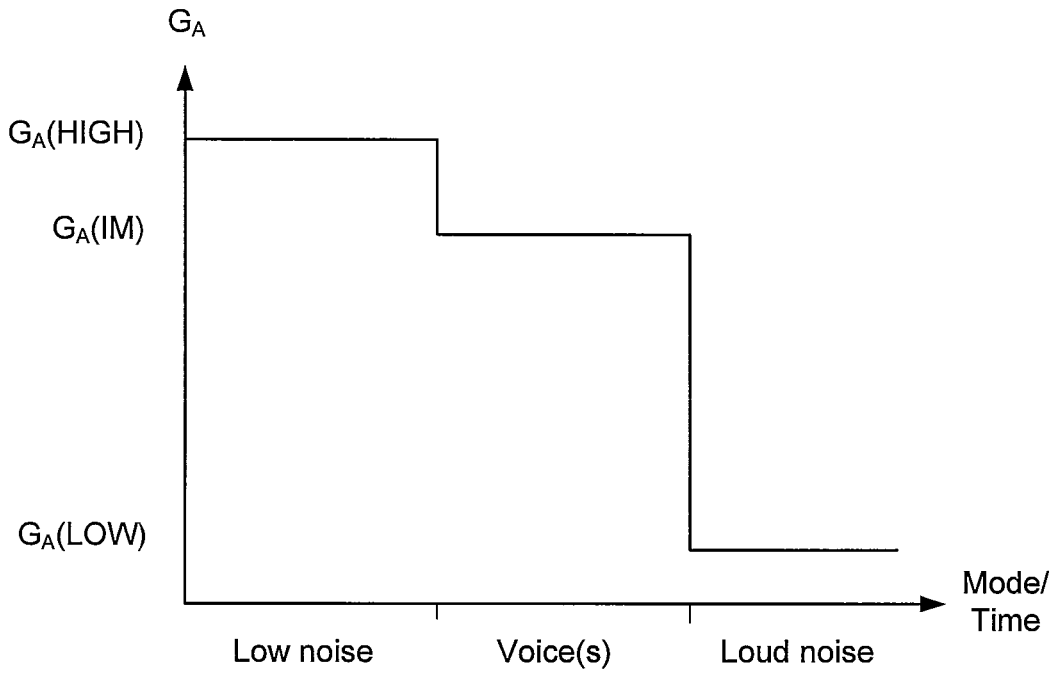
FIG. 2 shows examples of classification schemes for different acoustic environments, FIG. 2*a* schematically showing relative gain settings for the signal picked up by a microphone system of a listening instrument in different acoustic environments of the listening instrument, FIGS. 2*b* and 2*c* schematically showing relative gain settings $G_A$, $G_W$ for a microphone signal and a directly received electric audio signal, respectively, in different acoustic environments as extracted from different detectors in a three level gain scheme and a two level gain scheme, respectively.

In an embodiment, the control- and detector-unit (C-D) comprises a voice detector (VD) adapted to determine if a voice is present in the (electric) microphone signal. Voice detectors are known in the art and can be implemented in many ways. Examples of voice detector circuits based on analogue and digitized input signals are described in U.S. Pat. No. 5,457,769 and US 2002/0147580, respectively. The voice detector can e.g. be used to decide whether voices are present in the microphone signal (in case of the simultaneous presence of an own-voice detector, to decide whether voices are present in the 'noise part' of the microphone signal where the user's own voice is NOT present). In such case a three level gain modification of the microphone signal ($G_A$ in FIG. 1*b*) can be implemented, cf. FIG. 2*a* sketching gain level $G_A$ of the microphone gain unit $G_A$ for applying a specific microphone gain to the microphone signal MI versus mode or time. In FIG. 2*a* it is assumed that in a first time period or mode, the acoustic environment is characterized as LOW NOISE, in a second time period or mode as VOICE(s) and in a third time period or mode as LOUD NOISE. The gain level $G_A$ has three different levels $G_A$(HIGH), $G_A$(IM), and $G_A$(LOW) for the three different acoustic environments LOW NOISE, VOICE (s) and LOUD NOISE, respectively, considered. $G_A$(HIGH) represents a relatively high gain value, $G_A$(IM) an intermediate gain value, and $G_A$(LOW) a relatively low gain value of a three level gain scheme, respectively.

It is assumed that a direct electric input and a microphone input are simultaneously present.

In this case, a gain setting algorithm can be expanded with an intermediate setting $G_A$(IM), $G_W$(IM), where both gains are relatively high, but still lower than the HIGH values $G_A$(HIGH), $G_W$(HIGH).

In a noisy surrounding with no speech, the microphone gain is reduced (e.g. to $G_A$(LOW)), and/or the gain of the direct electrical input is increased (e.g. to $G_W$(HIGH)). In loud environments with speech, the gain of the direct electrical input is increased (e.g. to $G_W$(HIGH)) without attenuating the surrounding audio sounds picked up by the microphone unit (e.g. keeping $G_A$(IM)) enabling the user to understand the electrical input while at the same time being able to conduct a conversation in the users' physical proximity. In silent environments with speech, the same signal to noise ratio can be achieved with lesser or no attenuation of the microphone signal (e.g. $G_A$(IM)), and lesser or no additional gain on the direct electrical input (e.g. $G_W$(IM)). In silent environments without speech, an intermediate gain ($G_A$(IM)) on the microphone signal is preferably applied, whereas an intermediate or high gain ($G_W$(IM) or $G_W$(HIGH)) on the direct electric input is preferably applied. Such gain strategy vs. acoustic environment as determined by a level detector (LD) and a voice detector (VD) is illustrated in the table of FIG. 2*b*.

In an embodiment, only two levels (LOW and HIGH, respectively) of regulation of the gains $G_A$, $G_W$ applied to electric microphone and the direct electric input signals, respectively for improving the signal to noise ratio of the combined signals are provided. In an embodiment, the settings of $G_A$ and $G_W$ in response to the binary settings of the two detectors LD and VD are as shown in the table of FIG. 2*c*:

In an embodiment, the gain differences G(HIGH)−G (LOW) are larger than or equal to 5 dB, e.g. larger than or equal to 10 dB, such as larger than or equal to 20 dB.

In general, the level detector LD may be adapted to operate in a continuous mode (i.e. not confined to a binary or a three level output). Hence, the system may likewise be adapted to regulate the gains $G_A$ and $G_W$ continuously (i.e. not necessarily to apply only two or three values to the gains).

In an embodiment, the gains $G_A$ and $G_W$ are continuously regulated to implement a constant signal (MAG(direct electric input)) to noise (MAG(electric microphone input)) ratio.

Preferably, the gain modifications based on signals from the detectors are implemented with a certain delay (and possibly include time averaging), e.g. of the order of 0.5 s to 1 s, to prevent immediate gain changes due to signals occurring for a short time.

In the embodiment of a control- and detection-unit (C-D) shown in FIG. 1*c*, the microphone input MI is fed to each of the detectors LD, OVD and VD. The own-voice detector OVD is used to generate a (e.g. binary) control signal OV-NOV indicating whether or not a user's own voice is present versus time. The control signal is fed to the level detector LD for controlling the times during which a noise level of the local environment is measured/estimated by the level detector. The output of the own-voice detector OVD may additionally be fed to the processing unit PU. The level detector LD provides a control signal NL representing the input level of the electric microphone signal as a function of time, e.g. a noise level, which is fed to the processing unit PU and used in the generation of one or more of the control signals CGA, CGW, CW for controlling the gain setting of the $G_A$ and $G_W$ units and for controlling the mixing or weighting unit W, respectively (cf. FIG. 1*b*). The voice detector VD is used to detect whether a human voice is present in the local acoustic environment (i.e. present in the electric microphone signal), which is reflected in the output control signal V-NV fed to the processing unit PU and used in the generation of one or more of the control signals CGA, CGW, CW.

Other detectors (e.g. frequency analyzer, modulation detector, etc.) may be implemented to classify the acoustic environment and/or to control the gain setting (CGA, CGW) and/or the weighting (CW) of the modified electric microphone and direct electric input signals.

FIG. 3 shows different application scenarios and corresponding exemplary acoustic environments of embodiments of a listening instrument LI as described in the present application. The different acoustic environments comprise different sound sources.

Figure 3A:
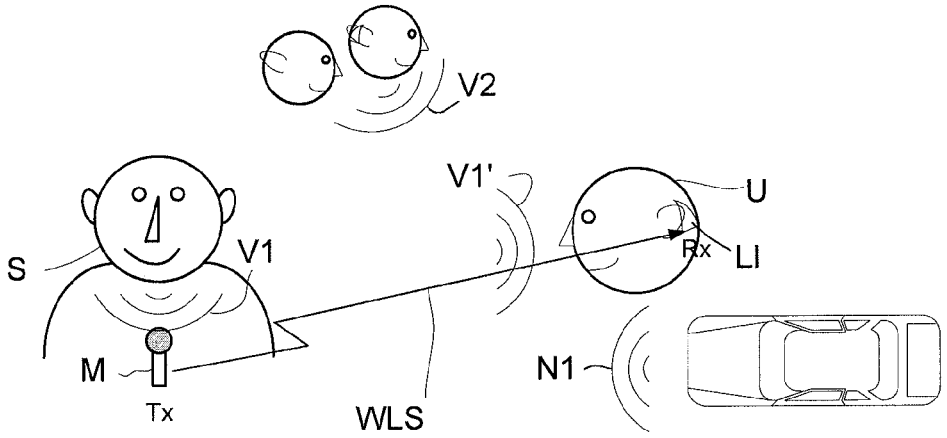
FIG. 3 shows different application scenarios of embodiments of a listening instrument and corresponding exemplary acoustic environments, FIG. 3*a* illustrating a single user listening situation, FIG. 3*b* illustrating a single user telephone conversation situation.

FIG. 3*a* illustrates a single user listening situation, where a user U wearing the listening instrument LI receives a direct electric input via wireless link WLS from a microphone M (comprising transmitter antenna and circuitry Tx) worn by a speaker S producing sound field V. A microphone system of the listening instrument additionally picks up a propagated (and delayed) version V' of the sound field to, voices V2 from additional talkers (symbolized by the two small heads in the top part of FIG. 3*a*) and sounds N1 from traffic (symbolized by the car in FIG. 3*a*) in the environment of the user U. The audio signal of the direct electric input and the mixed acoustic signals of the environment picked up by the listening instrument and converted to an electric microphone signal are subject to a gain strategy as described by the present teaching and subsequently mixed (and possibly further processed) and presented to the user U via an output transducer (e.g. included in the listening instrument) adapted to the user's needs.

Figure 3B:
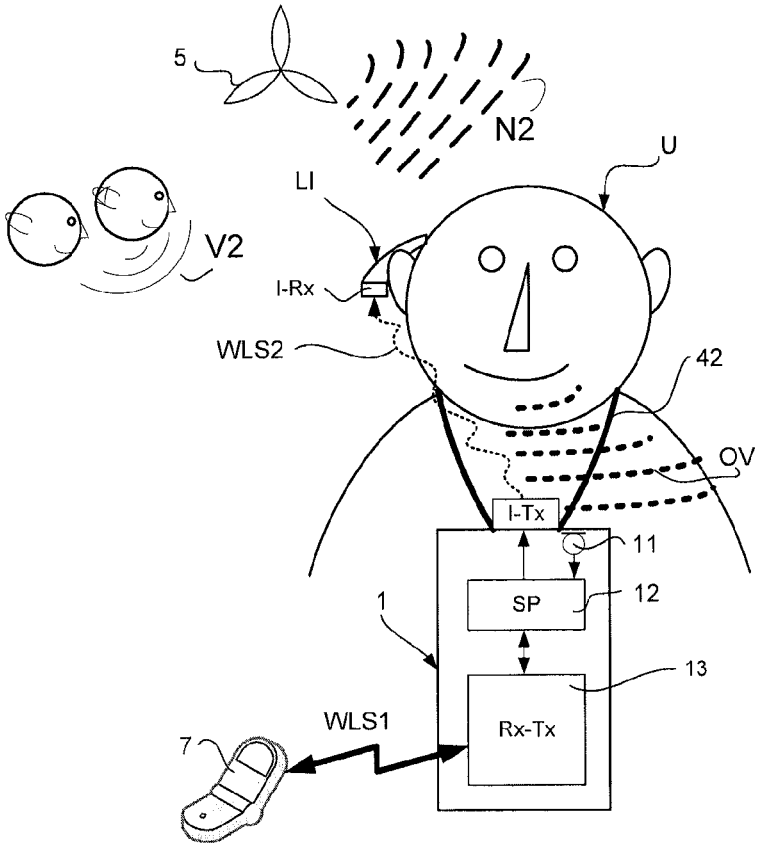

FIG. 3*b* illustrates a single user telephone conversation situation, wherein the listening instrument LI cooperates with a body worn device, here a neck worn device 1. The neck worn device 1 is adapted to be worn around the neck of a user in neck strap 42. The neck worn device 1 comprises a signal processing unit SP, a microphone 11 and at least one receiver of an audio signal, e.g. from a cellular phone 7 as shown (e.g. an antenna and receiver circuitry for receiving and possibly demodulating a wirelessly transmitted signal, cf. link WLS1 and Rx-Tx unit in FIG. 3*b*). The listening instrument LI and the neck worn device 1 are connected via a wireless link WLS2, e.g. an inductive link, where an audio signal is transmitted via inductive transmitter I-Tx of the neck worn device 1 to the inductive receiver I-Rx of the listening instrument LI. In the present embodiment, the wireless transmission is based on inductive coupling between coils in the two devices or between a neck loop antenna (e.g. embodied in neck strap 42) distributing the field from a coil in the neck worn device to the coil of the ear worn device (e.g. a hearing instrument). The body or neck worn device 1 may form part of another device, e.g. a mobile telephone or a remote control for the listening instrument LI or an audio selection device (an audio gateway) for selecting one of a number of received audio signals and forwarding the selected signal to the listening instrument LI. The listening instrument LI is adapted to be worn on the head of the user U, such as at or in the ear (e.g. a listening device, such as a hearing instrument) of the user U. The microphone 11 of the body worn device 1 can e.g. be adapted to pick up the user's voice during a telephone conversation and/or other sounds in the environment of the user. The microphone 11 can e.g. be manually switched off by the user U.

Sources of acoustic signals picked up by microphone 11 of the neck worn device 1 and/or the microphone system of the listening instrument are 1) the users own voice OV, 2) voices V2 of persons in the users environment, 3) sounds N2 from noise sources in the users environment (here shown as a fan). The classification of the current acoustic environment is preferably performed or influenced by a control- and detection-unit (C-D) (e.g. as shown in FIG. 1*c*) of the listening instrument, based on the signals picked up by the microphone system of the listening instrument (cf. e.g. FIG. 1*b*).

An audio selection device, which may be modified and used according to the present invention is e.g. described in EP 1 460 769 A1 and in EP 1 981 253 A1.

Figure 4:
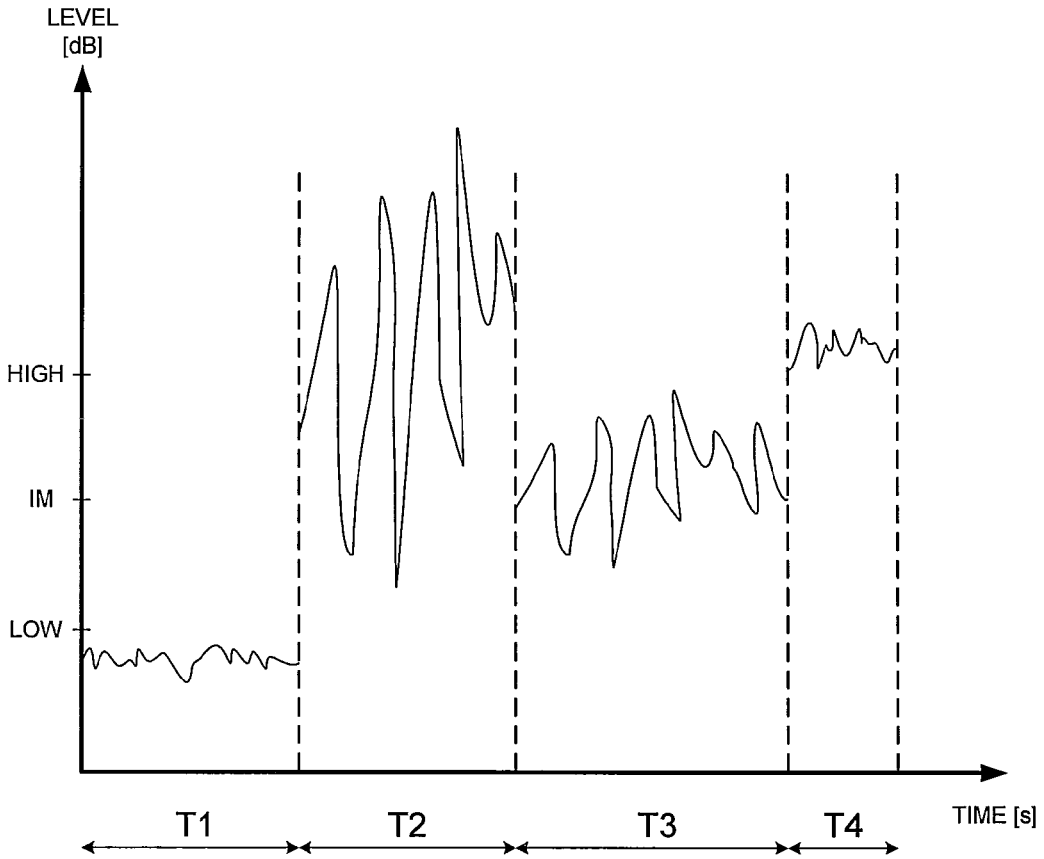
FIG. 4 shows a schematic example of the magnitude of different acoustic signals in a user's environment in different time segments (upper graph) and corresponding detector parameter values, extracted acoustic environment classifications and relative gain settings (lower table).

FIG. 4 shows a schematic example of the magnitude (LEVEL, [dB] scale) vs. time (TIME, [s] scale) of different acoustic signals in a user's environment in different time segments as picked up by a microphone system (upper graph), and corresponding detector parameter values provided by an own-voice detector (OWN-VOICE), a level detector (LEVEL) and a voice detector (VOICE), resulting extracted acoustic environment (AC. ENV.) classifications, and relative gain settings (lower table). The first time segment T1 schematically illustrates an acoustic noise source with relatively small amplitude variations and a relatively low average level (LOW). Such environment is classified as a LOW-NOISE environment for which no voice is present and a relatively low microphone input (noise) level is detected by the LD. The gain $G_A$ of the microphone signal and the gain $G_W$ of the direct electrical input are both set to intermediate values $G_A$(IM), $G_W$(IM), respectively. The second time segment T2 schematically illustrates the user's own voice with relatively large amplitude variations and a relatively high average level (HIGH). Such environment is classified as an OWN-VOICE environment for which no gain regulation is performed (the gains $G_A$ and $G_W$ are maintained at their previous setting or set to default values appropriate for the own voice situation). The third time segment T3 schematically illustrates a background voice with intermediate amplitude variations and an intermediate average level (IM). Such environment is classified as a VOICE environment. The gain $G_A$ of the microphone signal is set to an intermediate value $G_A$(IM), and the gain $G_W$ of the direct electrical input is set to a high value $G_W$(HIGH). The fourth time segment T4 schematically illustrates an acoustic noise source with relatively small amplitude variations and a relatively high average level (HIGH). Such environment is classified as a HIGH-NOISE environment for which no voice is present and a relatively high microphone input (noise) level is detected by the LD. The gain $G_A$ of the microphone signal is set to a relatively low value $G_A$(LOW), and the gain $G_W$ of the direct electrical input is set to a relatively high value $G_W$(HIGH).

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

REFERENCES

EP 1 691 574 A2 (PHONAK) Aug. 16, 2006
U.S. Pat. No. 5,473,701 (AT&T) Dec. 5, 1995
WO 99/09786 A1 (PHONAK) Feb. 25, 1999
EP 2 088 802 A1 (OTICON) Aug. 12, 2009
WO 03/081947 A1 (OTICON) Oct. 2, 2003
U.S. Pat. No. 5,144,675 (ETYMOTIC RES) Sep. 1, 1992
WO 2004/077090 A1 (OTICON) Sep. 10, 2004
EP 1 956 589 A1 (OTICON) Aug. 13, 2008
U.S. Pat. No. 5,457,769 (EARMARK) Oct. 10, 1995
US 2002/0147580 A1 (LM ERICSSON) Oct. 10, 2002
EP 1 460 769 A1
EP 1 981 253 A1.

The invention claimed is:

1. A listening instrument adapted for being worn by a user, the listening instrument comprising:

a microphone unit for picking up an input sound from a current acoustic environment of the user and converting said input sound to an electric microphone signal;

a microphone gain unit for applying a specific microphone gain ($G_A$) to the electric microphone signal and providing a modified microphone signal, the microphone gain unit setting at least a low value and a high value larger than the low value as the microphone gain;

a direct electric input interface configured to receive a direct electric input signal different from the electric microphone signal, the direct electric input signal representing an audio signal;

a direct gain unit for applying a specific direct gain ($G_W$) to the direct electric input signal received through the direct electric input interface and providing a modified direct electric input signal, the direct gain unit setting at least a low value and a high value larger than the low value as the direct gain;

a detector unit for classifying the current acoustic environment of said user and providing one or more classification parameters representing the classification of the current acoustic environment;

a control unit for controlling at least one of the specific microphone gain applied to the electric microphone signal and the specific direct gain applied to the direct electric input signal based on the one or more classification parameters; and a level detector for determining the input level of the electric microphone signal, wherein the detector unit comprises an own-voice detector (OVD) configured to classify the electric microphone signal as containing voice of said user or not containing the voice of said user at a given point in time, and the control unit is configured to estimate a noise input level during periods where the voice of said user is not detected, and use the noise input level to adjust at least one of the microphone gain applied to the electric microphone signal and the direct gain applied to the direct electric input signal to maintain a constant signal to noise ratio.

2. A listening instrument according to claim 1 comprising a mixing unit for allowing a simultaneous presentation of the modified microphone signal and the modified direct electric input signal.

3. A listening instrument according to claim 1 wherein the detector unit comprises a level detector (LD) for determining the input level of the electric microphone signal.

4. A listening instrument according to claim 3 adapted to use the input level to adjust the gain of the microphone and/or the electric input signal in connection with a telephone conversation, when the direct electric input represents a telephone input signal.

5. A listening instrument according to claim 1 wherein the detector unit comprises a voice detector (VD) for determining whether or not the electric microphone signal comprises a voice signal.

6. A listening instrument according to claim 1 wherein the detector unit is adapted to classify the microphone signal as HIGH-NOISE or LOW-NOISE signal.

7. A listening instrument according to claim 1, adapted to estimate a NOISE input level during periods where the voice of said user is NOT detected.

8. A listening instrument according to claim 7 adapted to use the NOISE input level to adjust the gain of the microphone and/or the electric input signal to maintain a constant signal to noise ratio.

9. A listening instrument according to claim 1, wherein the control unit is adapted to apply at least one of the low value of microphone gain ($G_A$) and the high value of direct gain ($G_W$) in case the current acoustic environment of the user is classified as a relatively HIGH-LEVEL or NOISE environment.

10. A listening instrument according to claim 1, wherein the control unit is adapted to apply at least one of the high value of microphone gain ($G_A$) and the high value of direct gain ($G_W$) in case the current acoustic environment of the user is classified as a relatively LOW-LEVEL or NO-NOISE environment.

11. A listening instrument according to claim 1, wherein the control unit is adapted to apply at least one of an intermediate value of microphone gain ($G_A$) between the low value and the high value of microphone gain and an intermediate value of direct gain ($G_W$) between the low value and the high value of direct gain in case the current acoustic environment of the user is classified as comprising VOICE.

12. The listening instrument according to claim 1, further comprising:

a behind-the-ear unit configured for placement behind an ear of the user.

13. The listening instrument according to claim 1, further comprising:

an antenna configured to wirelessly receive the direct electric input signal.

14. The listening instrument according to claim 1, comprising a hearing aid.

15. A method of operating a listening instrument adapted for being worn by a user, the method comprising:

converting an input sound from a current acoustic environment of the user to an electric microphone signal with a microphone of the listening instrument;

applying a specific microphone gain ($G_A$) to the electric microphone signal with a microphone gain unit and providing a modified microphone signal, the microphone gain unit setting at least a low value and a high value larger than the low value as the microphone gain;

providing through a direct electric input interface a direct electric input signal different from the electric microphone signal, the direct electric input signal representing an audio signal;

applying a specific direct gain ($G_W$) to the direct electric input signal with a direct gain unit and providing a modified direct electric input signal, the direct gain unit setting at least a low value and a high value larger than the low value as the direct gain;

classifying the current acoustic environment of the user and providing one or more classification parameters representing the classification of the current acoustic environment;

controlling at least one of the specific microphone gain applied to the electric microphone signal and the specific direct gain applied to the direct electric input signal based on the one or more classification parameters;

classifying the electric microphone signal as containing voice of said user or not containing the voice of said user at a given point in time;

determining the input level of the electric microphone signal;

estimating a noise input level during periods where the voice of said user is not detected, and using the noise input level to adjust at least one of the microphone gain applied to the electric microphone signal and the direct gain applied to the direct electric input signal to maintain a constant signal to noise ratio.

16. A non-transitory tangible computer-readable medium storing a computer program comprising program code instructions for causing a data processing system to perform the steps of the method of claim 15, when said computer program is executed on the data processing system.

17. The method according to claim 15, further comprising:

placing the listening instrument on the ear of the user.

18. The method according to claim 15, wherein said providing the direct electric input signal includes receiving the direct electric input signal wirelessly by an antenna of the listening instrument.

19. A listening system, comprising:

a listening instrument configured to be worn by a user, the listening instrument including a behind-the-ear portion configured to be worn behind the user's ear;

a microphone configured to receive an input sound from a current acoustic environment of the user and to convert the input sound into an electric microphone signal;

a microphone gain unit configured to apply a specific microphone gain ($G_A$) to the electric microphone signal and to provide a modified microphone signal, the microphone gain unit setting at least a low value and a high value larger than the low value as the microphone gain;

an antenna configured to wirelessly receive a direct electric input signal different from the electric microphone signal, the direct electric input signal representing an audio signal from an auxiliary device;

a direct gain unit configured to apply a specific direct gain ($G_W$) to the direct electric input signal received by the antenna and to provide a modified direct electric input signal, the direct gain unit setting at least a low value and a high value larger than the low value as the direct gain;

a detector configured to classify the current acoustic environment of the user and to provide one or more classification parameters representing the classification of the current acoustic environment, the detector including an own-voice detector configured to classify the electric microphone signal as containing voice of said user or not containing the voice of said user at a given point in time;

a processor configured to control at least one of the specific microphone gain applied to the electric microphone signal and the specific direct gain applied to the direct electric input signal based on the one or more classification parameters; and a level detector for determining the input level of the electric microphone signal; and the auxiliary device that wirelessly transmits the direct electric input signal to the listening instrument, wherein the listening instrument is adapted to:

estimate a noise input level during periods where the voice of said user is not detected, and use the noise input level to adjust at least one of the microphone gain applied to the electric microphone signal and the direct gain applied to the direct electric input signal to maintain a constant signal to noise ratio.

20. The listening system according to claim 19, wherein the auxiliary device is an audio gateway device and wirelessly receives the audio signal from a mobile telephone.

21. The listening system according to claim 19, wherein the audio gateway device receives the audio signal from a music player through a wired connection.

22. The listening system according to claim 19, wherein the auxiliary device is a mobile telephone.

23. The listening system according to claim 19, wherein the auxiliary device is a remote control of the listening instrument.

24. The listening system according to claim 19, wherein the listening instrument is a hearing aid.

* * * * *